United States Patent [19]

Corba

[11] 4,171,758

[45] Oct. 23, 1979

[54] CHILD-SAFE ACTUATOR FOR PRESSURIZED CONTAINER

[75] Inventor: Robert E. Corba, Racine, Wis.

[73] Assignee: S. C. Johnson & Son, Inc., Racine, Wis.

[21] Appl. No.: 786,750

[22] Filed: Apr. 11, 1977

[51] Int. Cl.[2] ..... B65D 83/14

[52] U.S. Cl. ..... 222/402.11; 222/402.13

[58] Field of Search ..... 222/402.11, 402.13, 222/153

[56] References Cited

U.S. PATENT DOCUMENTS

| | | | |
|---|---|---|---|
| 3,169,672 | 2/1965 | Soffer et al. | 222/402.11 X |
| 3,184,116 | 5/1965 | Huling | 222/402.11 |
| 3,642,179 | 2/1972 | Micallef | 222/402.13 X |
| 3,651,993 | 3/1972 | Venus | 222/402.11 X |

*Primary Examiner*—Francis J. Bartuska

[57] ABSTRACT

An actuator for mounting on the end of a pressurized container from which a centrally located, depressible valve stem protrudes. The actuator is characterized by a base surrounding the axis defined by the stem, an actuator tab hinged to the base and extending across the axis to terminate in a finger-depressible free end, a stem-engaging member on the tab which forms with the tab a passageway terminating in a discharge orifice, and a disabling member on the base adjacent the free end and moveable between a locked position blocking tab depression and an unlocked non-blocking position. Other preferred features relate to a hinge attachment of the disabling member to the base, a snappingly engageable catch on the disabling member to engage the tab, a cam on the disabling member to direct the tab upwardly as the disabling member is moved to the locked position, a ledge at the tab free end blocking access to the catch means, and a one-piece construction of the entire structure.

7 Claims, 7 Drawing Figures

CHILD-SAFE ACTUATOR FOR PRESSURIZED CONTAINER

BACKGROUND OF THE INVENTION

This invention relates to the field of actuators for pressurized containers and in particular to child-safe actuators of the type intended to prevent actuation by children of tender years.

During recent years pressure packaging has developed into one of the most popular forms of packaging for fluid products. Such packages, usually cylindrical metal cans having a dispensing valve at one end, have tremendous advantages in convenience and ease of product application. Their popularity is evidenced by the fact that many billions of such packages (usually known as "aerosols") are used each year.

Many highly corrosive and potentially harmful products, which are dangerous if improperly used, are conventionally packaged in pressurized cans for ease of application of the product. Such products include various household chemicals such as insecticides, starches, and oven cleaners, and other products such as paints, hair sprays, and the like which may, under certain circumstances, be harmful to small children and pets or injurious to furniture, carpets, and the like. Although pressurized packaging in general has shown itself to be one of the safest forms of packaging, efforts are continually being made to improve product safety; and, it can be demonstrated that the safety of aerosol devices has improved in recent years. One aspect of the safety effort has been an attempt to render the contents of aerosol containers inaccessible to children of tender years. Aerosol devices which accomplish this have been given the designation "child-safe."

Many of these devices are complicated in nature and expensive in construction. With others, the method of operation is not plain to an observer and a significant educational process may be required. Some child-safe devices fail to have distinct, positive and visible on-off conditions. Some may be unlocked by random, unintentional actions; others do not display their condition to an adult observer. There is a need for a reliable one-piece molded child-safe actuator overcoming the aforementioned problems and deficiencies. There is need for an improved, reliable, simple, inexpensive actuator device, the condition of which and operation of which would be apparent to observers without engaging in a significant educational process.

SUMMARY OF THE INVENTION

This invention provides an actuator of the type for mounting on a pressurized container at the end thereof from which a centrally located, depressible valve stem protrudes. Like many other actuators or actuator-overcaps, this invention includes a base attachable to the container at a position radially spaced from and surrounding an axis defined by the valve stem. Preferably, the actuator base is attachable to a container at the valve cup bead or at the doubleseam by which a container dome is attached to a cylindrical can body.

The invention includes an actuator tab forming a second class lever for depressing the stem. The actuator tab is hinged to the base and extends across the stem to terminate in a finger-depressible free end. On the underside of the actuator tab, preferably formed with the actuator tab, is a stem-engaging sleeve member which, together with the tab, forms a passageway terminating in a discharge orifice. When the actuator tab is depressed, pressurized product flows through the valve stem, the stem-engaging member and the passageway formed in the tab, exiting through the discharge orifice.

The inventive device is characterized by a disabling member connected to the base adjacent the tab free end and interacting with the tab to provide the child-safe feature of this invention. The disabling member is moveable between a locked position blocking depression of the tab and a non-blocking unlocked position. The disabling member normally includes a finger-engagable surface which may be pressed to move the disabling means to its locked position. Preferred embodiments include a camming means on the disabling means facing the free end of the tab to move the tab upwardly (when the container is in upright position) to its non-depressed position as pressure is applied on the finger-engagable surface of the disabling means.

In some preferred embodiments, the disabling member is hinged to the base and includes a catch movable, with the disabling member, between the locked and unlocked positions. The catch is preferably snappingly engageable with the tab. In some preferred embodiments, the free end of the tab has a ledge which covers a portion of the disabling member to prevent fingernail access thereto and thus discourage unlocking by children of tender years.

The disabling member is preferably hinged to the base in a manner allowing it to pivot about a line substantially perpendicular to the plane defined by the stem axis and a radius along the actuator tab. However, hinges in other orientations are acceptable.

Preferred embodiments of this invention are of one-piece construction, thereby reducing construction costs and providing a reliable, one-piece child-safe actuator.

The actuator of this invention has a child-safe feature the condition of which (either locked or unlocked) is readily apparent to any casual adult observer. The actuator of this invention has the advantage, therefore, of suggesting to the user the necessity of a conscious action to return the actuator to a child-safe condition. Furthermore, the actuator of this invention is clearly either off or on; there is little opportunity for random, unintentional movements by a child which might have the effect of returning the device to an unlocked, unsafe condition.

OBJECTS OF THE INVENTION

It is an object of this invention to provide a child-safe actuator for pressurized containers which overcomes certain problems of the prior art.

Another object of this invention is to provide a reliable child-safe actuator for pressurized containers.

Another object of this invention is to provide a child-safe actuator for pressurized containers the condition and operation of which are readily apparent to an observer without extensive education in its manner of use.

Another object of this invention is to provide a child-safe actuator which is simple in construction and relatively low in cost.

These and other important objects of the invention will become apparent from the following description and drawings showing preferred embodiments of the invention.

DETAILED DESCRIPTION OF PREFERRED EMBODIMENTS

Throughout the drawings like numerals are used to identify like parts.

Figure 1:
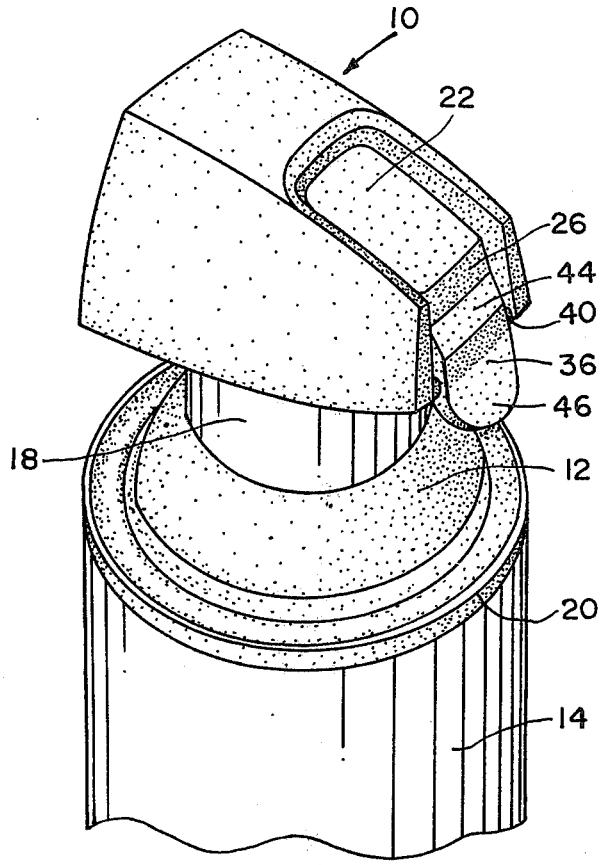
FIG. 1 is a perspective view of an actuator of this invention, attached to a pressurized container.
Figure 2:
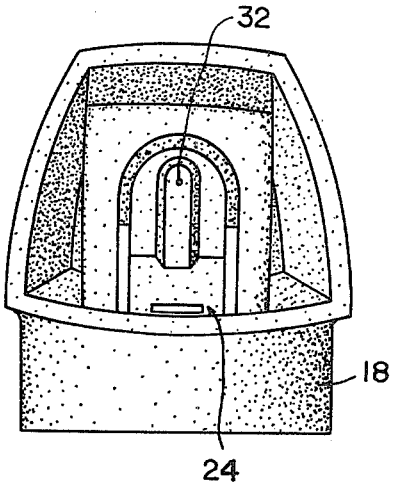
FIG. 2 is a front elevation of the device of FIG. 1.

FIG. 1 illustrates an actuator 10 according to this invention mounted on the end 12 of a pressurized container 14 from which a centrally located, depressible valve stem (not shown) protrudes. Container 14 is a cylindrical container having its valve stem located on the axis of the cylinder at the position identified by number 16 in FIG. 4 (stem not shown). Container 14, its valve and valve stem are all as well known in the art.

Actuator 10 includes a base 18 which is attached to container 14 around the valve cup bead, which is at a position radially spaced from and surrounding the axis defined by the valve stem. The base of the actuator of this invention may be made attachable to the end of a pressurized container at other positions radially spaced from and surrounding the stem axis. Doubleseam 20 is another preferred point of connection between the container and the actuator base. In any case, the connection may be made by a friction fit or otherwise, all as well known to those skilled in the art.

As best illustrated in FIGS. 4–7, actuator 10 includes an actuator tab 22 hinged to base 18 at hinge point 24 and extending across the axis defined by the stem to terminate in a finger-depressible free end 26. Formed with tab 22 on the underside thereof is a stem-engaging member 28 which, together with tab 22, forms a passageway 30 terminating in a discharge orifice 32. When the valve stem is depressed to actuate the valve, the fluid contents of container 14 pass through the stem, passageway 30 and discharge orifice 32. Tab 22, which extends radially across actuator 10 and the axis defined by the valve stem, forms a second class lever useful for depressing the valve stem and actuating the valve. Free end 26 includes a portion 34 intended to be engaged by a user's finger when dispensing the contents of container 14. Depression of free end 26 in a direction parallel to the axis defined by the valve stem and toward container end 12 produces a valve stem depressing movement of stem-engaging member 28 toward container end 12.

Actuator 10 includes an element 36 which is connected to base 18 at a point of base 18 which is adjacent to free end 26 of tab 22. Element 36 forms a disabling member of particular importance in this invention. Disabling member 36 includes catch means 38 which is moveable with disabling member 36 between a locked position (shown in FIG. 4) blocking depression of tab 22 and a non-blocking unlocked position (shown in FIGS. 5, 6 and 7) which does not interfere with depression of tab 22.

Figure 3:
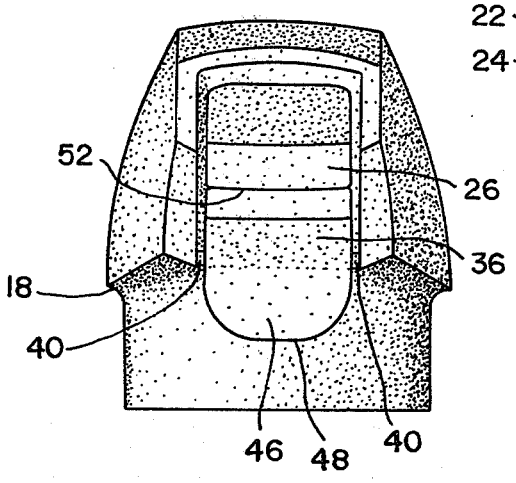
FIG. 3 is a rear elevation.

Disabling member 36 is hinged to base 18 at hinge 40 shown best in FIGS. 1 and 3. Hinge 40 defines a line about which disabling member 36 pivots. In the preferred embodiment illustrated in the drawings, disabling member 36 pivots about a line substantially perpendicular to the plane defined by the aforementioned stem axis and the radius along tab 22. This hinging arrangement of disabling member 36 is highly preferred. However, various other hinging arrangements and other connection means may be satisfactory for connecting disabling member 36 to base 18 adjacent to free end 26 of tab 22. In one possible alternate hinging arrangement, the disabling member would have a hinge parallel to a radius along tab 22 and thus engage free end 26 on its side, rather than at its remote end as in the embodiment shown in the drawings.

Figure 4:
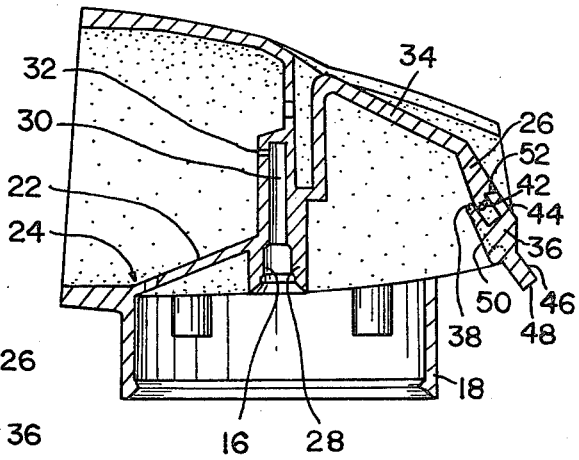
FIG. 4 is a sectional view taken along section 4—4 as indicated in FIG. 2.
Figure 5:
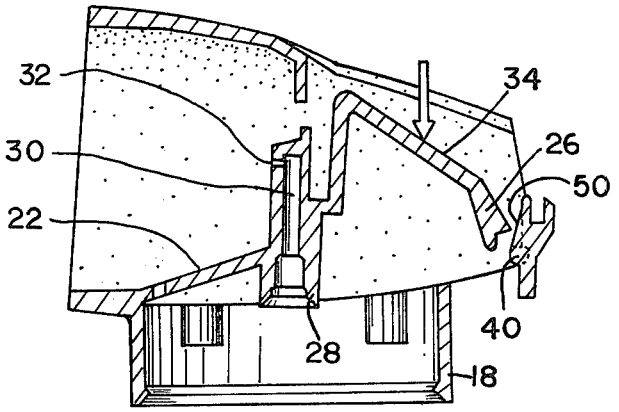
FIG. 5 is a sectional view similar to FIG. 4 but showing the actuator in depressed, unlocked position.

A snap-engageable means in the form of an edge 42 is formed in free end 26 of tab 22 such that it may be engaged with catch means 38 of disabling member 36. Engagement of snap-engageable means 42 and catch means 38 is shown in FIG. 4, which illustrates tab 22 in its non-depressed locked condition. The snap-engagement of disabling member 36 and free end 26 is highly preferred to assure a positive locked condition and prevent ready unlocking by children of tender years. A wide variety of snap-engageable forms may be used and would be obvious to those skilled in the art to whom this invention has been disclosed.

Disabling member 36 includes a first finger-engageable surface 44 which is pressed by an operator's finger to lock actuator 10 into its child-safe condition. Disabling member 36 has a second finger-engageable surface 46 at the opposite end of disabling member 36 which when depressed by an operator's finger disengages catch means 38 from snap-engageable means 42 to place actuator 10 in an unlocked condition, ready for use.

First finger-engageable surface 44 and second finger-engageable surface 46 are on opposite sides of hinge 40. The length of disabling member 36 from hinge 40 to the lower end 48 of disabling member 36 may be chosen to require that a given amount of pressure be applied before the snap-engagement of disabling member 36 with tab 22 is released. If such length is increased, the amount of pressure which must be applied to second finger-engageable surface 46 of disabling member 36 to unlock the child-safe device is reduced. On the other hand, if such length is shortened, the amount of finger pressure necessary to unlock the device is increased. Thus, the device may readily be designed to protect children of tender years and such protection is afforded not only through the degree of difficulty a small child might have in understanding the device but through the amount of pressure which must be exerted to unlock it. Other factors which determine the degree of difficulty in unlocking the device are the shapes of the interacting snap-engageable means and the surface lubricity thereof. With an understanding of this invention, one skilled in the art would recognize a variety of ways to achieve the desired degree of protection.

Figure 6:
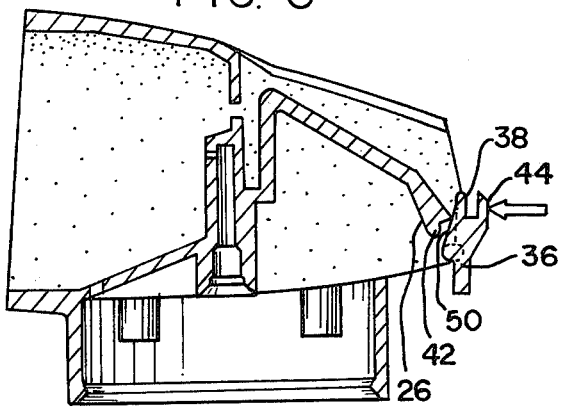
FIGS. 6 and 7 are sectional views as in FIGS. 4 and 5 but showing the actuator during return movement to its non-depressed, locked position, shown in FIG. 4.

As illustrated in FIGS. 4–7, disabling member 36 has a camming rib 50 formed therein to face and intersect with free end 26 of tab 22. As illustrated by FIG. 6, when finger pressure is applied to first finger-engageable surface 44 to move it toward its locked position, camming rib 50 engages free end 26 of tab 22 to move tab 22 toward its non-depressed position shown in FIG. 4. Camming rib 50 also serves the purpose of reinforcing disabling member 36 to provide some rigidity along the length thereof. Instead of a rib, however, two or more ribs may be used or a wider cam surface may be formed on disabling member 36. A wide variety of suitable embodiments would be apparent to those skilled in the art to whom this invention has been disclosed.

Free end 26 of tab 22 includes a ledge 52 which covers the upper end of disabling means 36 when it is in its locked position as shown best in FIGS. 1, 3 and 4. Ledge 52 thereby prevents fingernail access to catch means 38 which would otherwise be possible in a downward finger movement. This shielding ledge feature further reduces the likelihood that a young child will gain access to the contents of container 14.

In the illustrated embodiment, orifice 32 is directed in a radial direction along tab 22 toward hinge 24. Other orifice orientations and directions are also acceptable, depending on the intended application. Furthermore, the actuator tab may take on simple or complex configurations. It is required, however, that the tab function to actuate the valve substantially in the manner indicated.

Actuator 10 is integrally formed as a molded, one-piece plastic construction, preferably made of polypropylene. Other materials suitable for integrally formed embodiments will be apparent to those skilled in the art to whom this invention has been disclosed. Polypropylene is preferred for a one-piece construction because of its good strength characteristics and flexibility around the hinge areas referred to above. Various materials, preferably plastics, are usable for multi-piece embodiments; acceptable materials will be apparent to those skilled in the art. While a multi-piece construction is acceptable, the one-piece construction is highly preferred for reasons of simplicity and reliability in manufacture.

Figure 7:
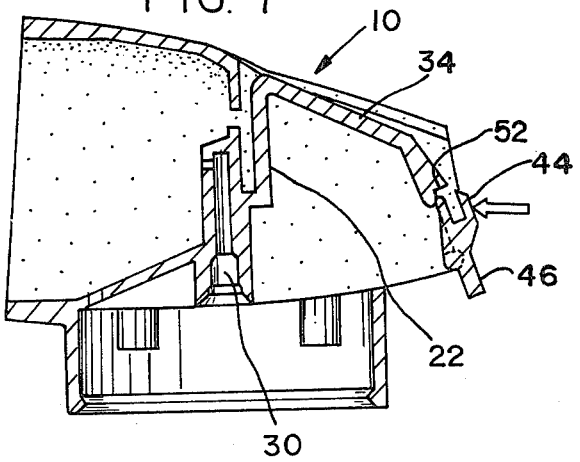

FIGS. 4–7 illustrate the sequence of operation of the child-safe actuator of this invention. As previously indicated, FIG. 4 shows the device in a locked condition. To unlock the device, pressure is applied by the operator's finger to second finger-engageable surface 46 of disabling member 36, overcoming the snap-engagement of disabling means 36 with free end 26 of tab 22. Such unlocking action results in the unlocked condition shown in FIG. 5, in which tab 22 may be depressed by the user's finger to actuate the dispensing valve (not shown). After dispensing some of the contents of the pressurized container, the user removes his finger from tab 22 and applies finger pressure to first finger-engageable surface 44 of disabling member 36, as shown in FIGS. 6 and 7. In FIG. 6, free end 26 of tab 22 is contacted by camming rib 50 of disabling member 36 causing tab 22 to move upwardly toward its non-depressed position. In FIG. 7, the user continues to apply pressure to first finger-engageable surface 44 for the purpose of engaging catch means 38 of disabling member 36 with snap-engageable means 42 of tab 22 and returning actuator 10 to the locked condition shown in FIG. 4.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. An actuator of the type for mounting on a pressurized container at the end thereof from which a centrally located, depressible valve stem protrudes, comprising:

a base attachable to a container at a position radially spaced from and surrounding an axis defined by said stem;

an actuator tab hinged to said base and extending across said axis to terminate in a finger-depressible free end, said tab forming a second class lever for depressing said stem;

a stem-engaging member on said tab, forming with the tab a passageway terminating in a discharge orifice; and disabling means connected through a pivot to said base adjacent to said free end and comprising a lever having first and second finger-engageable surfaces on opposite sides of said pivot, the first surface depressible to pivot the disabling means to a locked position blocking depression of said tab and the second surface depressible to pivot the disabling means to a non-blocking unlocked position, whereby said disabling means can conveniently be moved to either position by the operator's trigger finger while gripping said container for spraying.

2. The actuator of claim 1 made in one-piece construction.

3. The actuator of claim 1 wherein the disabling means has catch means and the tab has means snappingly engageable with said catch means.

4. The actuator of claim 3 made in one-piece construction.

5. The actuator of claim 1 wherein said disabling means pivots about a line substantially perpendicular to the plane defined by said axis and a radius along said tab.

6. The actuator of claim 5 wherein said free end has ledge means which covers said catch means when the disabling means is in locked position, thereby to prevent fingernail access to said catch means.

7. The actuator of claim 4 wherein said disabling means pivots about a line substantially perpendicular to a plane defined by said axis and a radius along said tab.

* * * * *